United States Patent [19]

Parsons

[11] Patent Number: 4,707,944

[45] Date of Patent: Nov. 24, 1987

[54] APPARATUS FOR HONING A CYLINDER

[76] Inventor: Edward K. Parsons, 866 Jackson Hwy., S., Toledo, Wash. 98591

[21] Appl. No.: 830,977

[22] Filed: Feb. 18, 1986

[51] Int. Cl.[4] ..... B24B 33/02

[52] U.S. Cl. ..... 51/34 F; 51/48 R; 51/331; 51/349; 51/290

[58] Field of Search ..... 51/34 R, 34 C, 34 D, 51/34 E, 34 F, 34 G, 43, 48, 49, 50 R, 165.93, 245, 261, 290, 330, 331, 349, 352, 354, 281 P; 409/143

[56] References Cited

U.S. PATENT DOCUMENTS

| | | | |
|---|---|---|---|
| 656,664 | 8/1900 | Roth | 51/34 R |
| 1,088,872 | 3/1914 | Bogey . | |
| 1,114,376 | 10/1914 | Milkop | 51/245 |
| 1,429,135 | 9/1922 | Gutenson . | |
| 1,445,154 | 2/1923 | Miller | 51/353 |
| 1,729,288 | 9/1929 | Harrell | 51/245 |
| 2,302,141 | 11/1942 | Perry | 51/245 |
| 2,546,490 | 3/1951 | Baldwin et al. . | |
| 2,693,066 | 11/1954 | Berstecher | 51/43 X |
| 3,548,548 | 12/1970 | Held . | |
| 4,229,908 | 10/1980 | Panzeri | 51/165.93 X |
| 4,327,526 | 5/1982 | Pettyjohn et al. | 51/245 |
| 4,383,395 | 5/1983 | Wilger et al. | 51/245 |

FOREIGN PATENT DOCUMENTS

| | | | |
|---|---|---|---|
| 120063 | 6/1945 | Australia | 51/34 D |
| 1121129 | 10/1984 | U.S.S.R. | 51/34 F |

*Primary Examiner*—Robert P. Olszewski

*Attorney, Agent, or Firm*—Chernoff, Vilhauer, McClung & Stenzel

[57] ABSTRACT

An apparatus for honing large, long, horizontally-oriented cylinders employs an elongate support beam, extending axially through the cylinder, to support a non-rotating honing head for axial movement within the cylinder. The honing head includes three honing stone assemblies, each stone assembly including a pair of honing stones and an air motor supportably mounted to the honing head by a trailing arm arrangement. Each honing stone assembly is individually biased toward the cylinder wall by an air cylinder, the biasing force variable according to the relative position of the respective stone assembly on the honing head to compensate for gravitational force upon the respective assemblies. Each stone assembly also includes an adjustable stop to selectively limit movement of the honing stones toward the cylinder wall. In operation the cylinder is rotated about its longitudinal axis while the honing head, with a plurality of rotating honing stones, is moved axially within the cylinder.

2 Claims, 6 Drawing Figures

APPARATUS FOR HONING A CYLINDER

BACKGROUND OF THE INVENTION

This invention relates to a method and apparatus for honing or grinding the inner cylinder wall of an elongate cylinder, and more particularly to a method and apparatus for honing or grinding the inner cylinder wall of an elongate, horizontally-oriented cylinder to approximate a perfect cylindrical shape.

Large long cylinders of a type used in the paper industry are customarily supported by a crowned beam extending therethrough, the inner cylinder wall resting upon the crown of the beam. When the cylinder is rotated, an oil injection system permits the cylinder to be rotatably supported by the crowned beam by maintaining a film of oil between the crown of the support beam and the inner cylinder wall. Despite the oil film, in time the inner cylinder wall and the crown become worn or scored and the inner cylinder wall may develop irregularities or become out-of-round. Therefore, it is necessary to periodically regrind the crown of the supporting beam and refinish the inner cylinder wall to ensure that it is smooth, even, and substantially perfectly cylindrical. The present invention provides a honing device capable of refinishing the inner cylinder wall of such a large, horizontally-oriented cylinder.

Applicant is aware of a number of prior honing devices. Most of these devices such as Gutenson, U.S. Pat. No. 1,429,135, Harrell, U.S. Pat. No. 1,729,288, Bogey, U.S. Pat. No. 1,088,872, Baldwin et al., U.S. Pat. No. 2,546,490 and Perry, U.S. Pat. No. 2,302,141 pertain to devices for honing relatively short, vertically-oriented cylinders such as the combustion cylinders of internal combustion engines, or, in the case of Perry, distributor body housings. Applicant is also aware of several devices for honing horizontally oriented cylinders such as Held, U.S. Pat. No. 3,548,548, Wilger et al., U.S. Pat. No. 4,383,395, and Pettyjohn et al., U.S. Pat. No. 4,327,526.

While many of the devices identified above are adjustable to fit the inner diameter of a cylinder, only one, Baldwin et al. discloses resiliently biasing the honing device against the cylinder wall. However, it should be noted that the Baldwin et al. device is self-centering, that is the biasing is accomplished by applying a reactive counter force against the diametrically opposed cylinder wall. Such self-centering honing devices tend to reproduce the circumferential shape of the cylinder wall including any irregularities in that circumferential shape.

SUMMARY OF THE INVENTION

The apparatus for honing the inner cylinder wall of an elongate cylinder according to the present invention includes an elongate support beam which extends axially through the cylinder and is supported independently of the cylinder. A nonrotating honing head including three honing stone assemblies is movably mounted on the support beam so as to be able to move axially within the cylinder. Each of the honing stone assemblies includes respective power means, pneumatic motors in the preferred embodiment, for rotating the honing stones. In addition, each of the honing stones has its own resilient biasing means for urging the honing stones toward the inner cylinder wall.

In the preferred embodiment, the biasing means extend between the honing head and each of the honing stone assemblies and are individually adjustable to selectively regulate the force with which each of the honing stones is urged toward the inner cylinder wall. This is important in honing horizontally-oriented cylinders since otherwise the weight of the respective honing stone assemblies would reduce the biasing force of the uppermost honing stone while adding to the biasing force of the lowermost honing stone.

In addition, the preferred embodiment of the present invention includes respective adjustable stops associated with each of the honing stone assemblies. These steps selectively limit the movement of the honing stones toward the inner cylinder wall so as to prevent a stone from extending into a port or slot in the inner cylinder wall and to enable the honing device to hone the inner cylinder wall to approximate a perfect cylindrical shape by setting the stops so that irregularities may be ground out of the inner cylinder wall.

The method according to the present invention includes supporting the honing head within the cylinder independently of the cylinder, rotating the cylinder about its longitudinal axis, causing the honing stones to contact the inner cylinder wall while the cylinder is rotating, and moving the honing head axially within the rotating cylinder to form the inner cylinder wall to approximate a perfect cylindrical shape.

Accordingly, it is a principal objective of the present invention to provide a method and apparatus for honing the inner cylinder wall of an elongate cylinder.

It is a further object to provide such a method and apparatus which is adapted to hone the inner cylinder wall of a long, horizontally-oriented cylinder.

It is a further objective of the present invention to provide such a method and apparatus for removing irregularities from the inner cylinder wall and causing the inner cylinder wall to approximate a perfect cylindrical shape.

The foregoing and other objections, features, and advantages of the invention will be more readily understood upon consideration of the following detailed description of the invention, taken in conjunction with the accompany drawings.

DETAILED DESCRIPTION OF THE INVENTION

Figure 1:
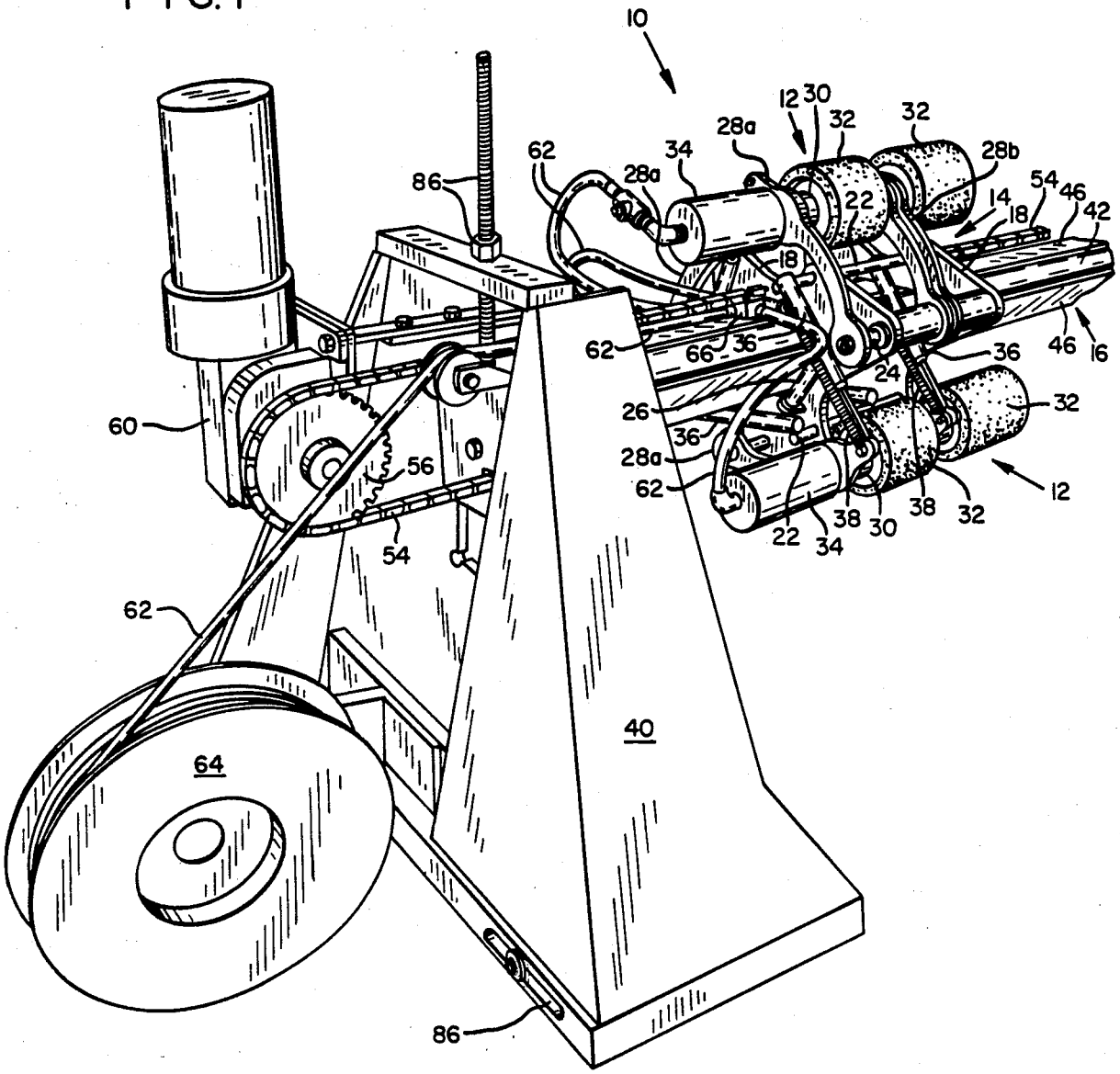
FIG. 1 is a perspective view of the honing head mounted on the support beam.

Referring to FIG. 1, an exemplary embodiment of the honing head 10 according to the present invention includes three honing stone assemblies 12 pivotally mounted to a carriage 14 which is movably supported on an elongate support beam 16.

Figure 2:
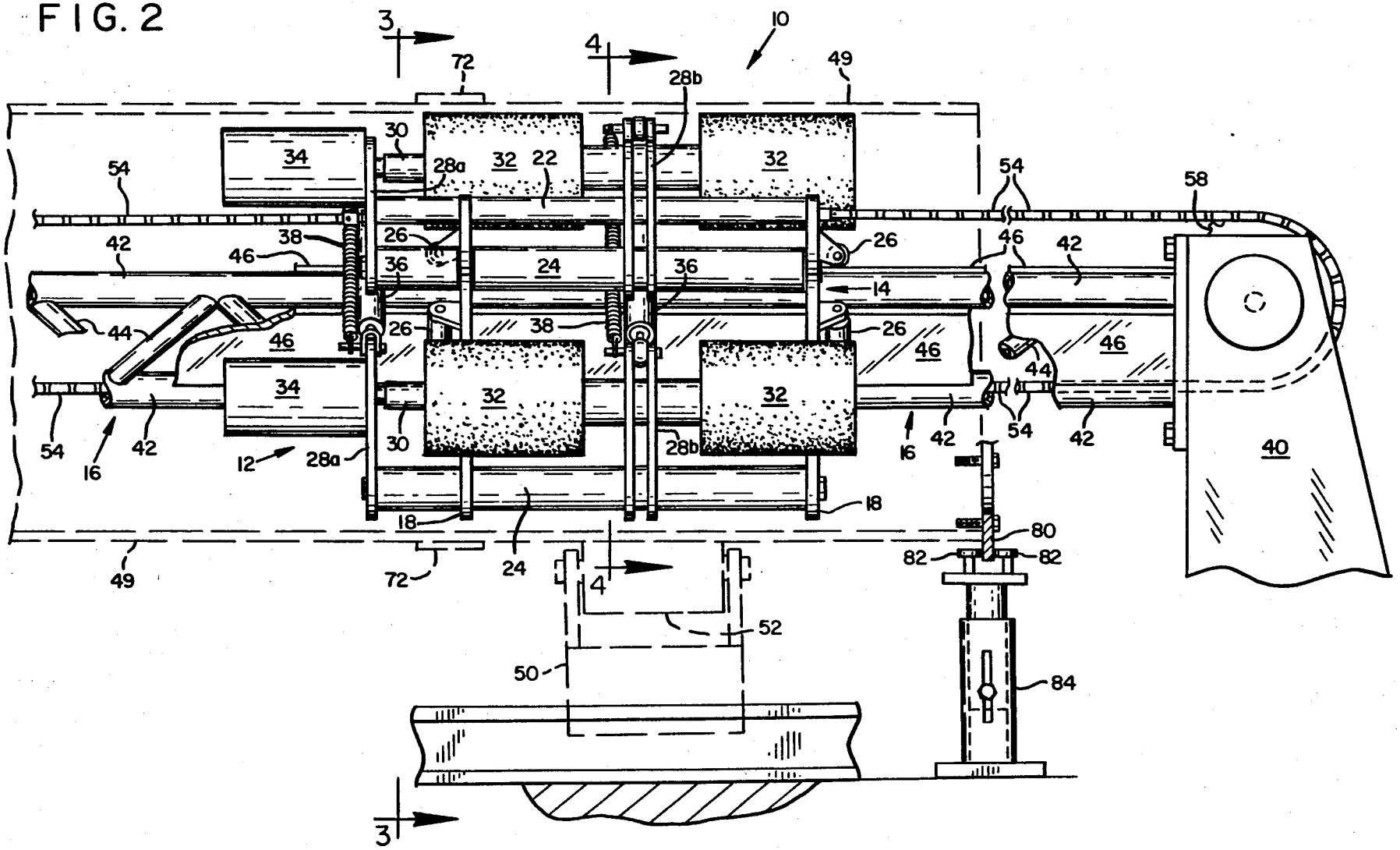
FIG. 2 is a side elevational view of the honing head and the support beam.
Figure 4:
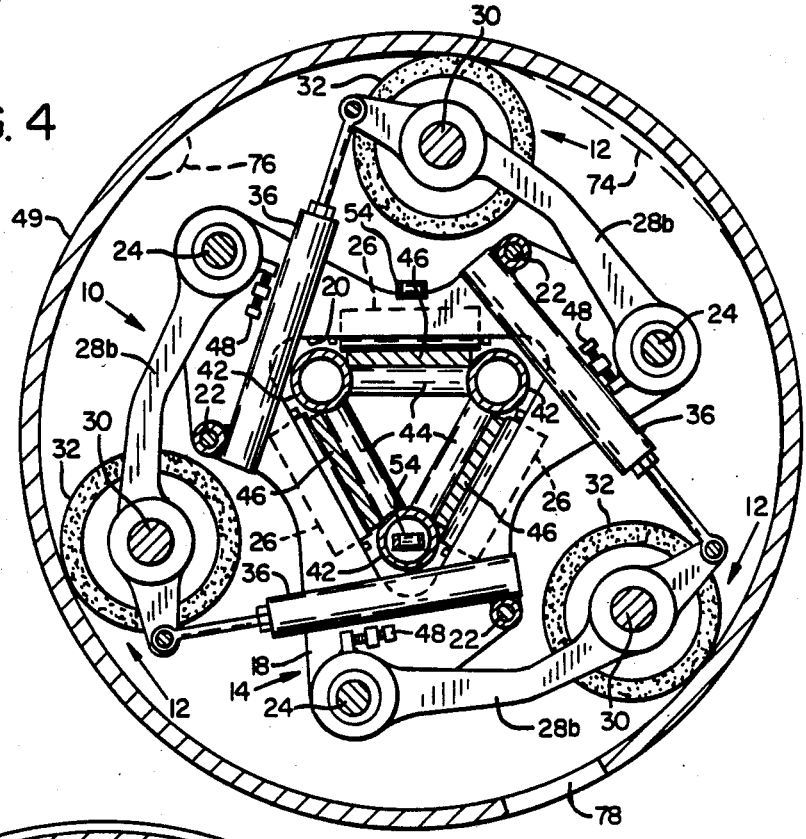
FIG. 4 is a cross-sectional view of the honing head and support beam taken along lines 4—4 of FIG. 2.
Figure 3:
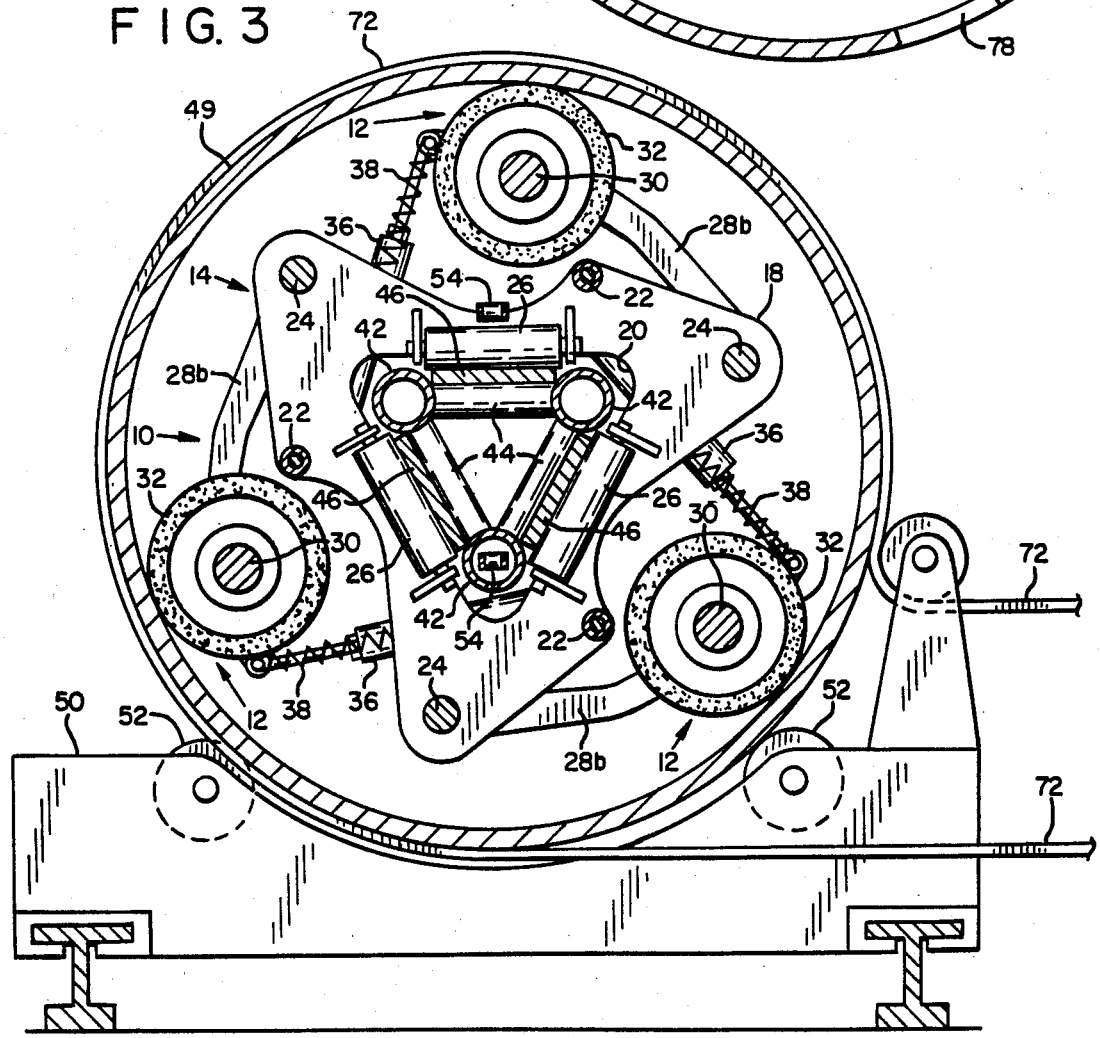
FIG. 3 is a cross-sectional view of the honing head and support beam taken along lines 3—3 of FIG. 2.

With reference also to FIGS. 2–4, the carriage includes a pair of opposed, substantially triangular end plates 18, each end plate having a triangular opening 20 therein. The end plates are held in parallel opposed relationship by three pivot shafts 24 extending between the end plates, each lobe of the triangular end plates held against a shoulder on the respective pivot shaft. Three carriage rollers 26 are mounted to each end plate near the triangular opening.

Referring still to FIGS. 1–4, each stone assembly 12 includes a single trailing arm 28*a* and a double trailing arm 28*b* which are journaled on a common pivot shaft. An arbor 30 is journaled for rotation between the outer ends of the trailing arms, 28*a* and *b*. Each arbor mounts a pair of cylindrical honing stones 32 and a pneumatic motor 34. Each stone assembly is supported by a pair of air cylinders 36, with return springs 38, extending between the carriage and the outer end of the trailing arms. The air cylinders are fastened to the carriage by pins 22 extending between the opposed end plates. Each stone assembly also includes adjustable stops 48, which may be seen in FIG. 4, cooperating between the end plates and the trailing arms, whose purpose and operation will be explained below.

Figure 5:
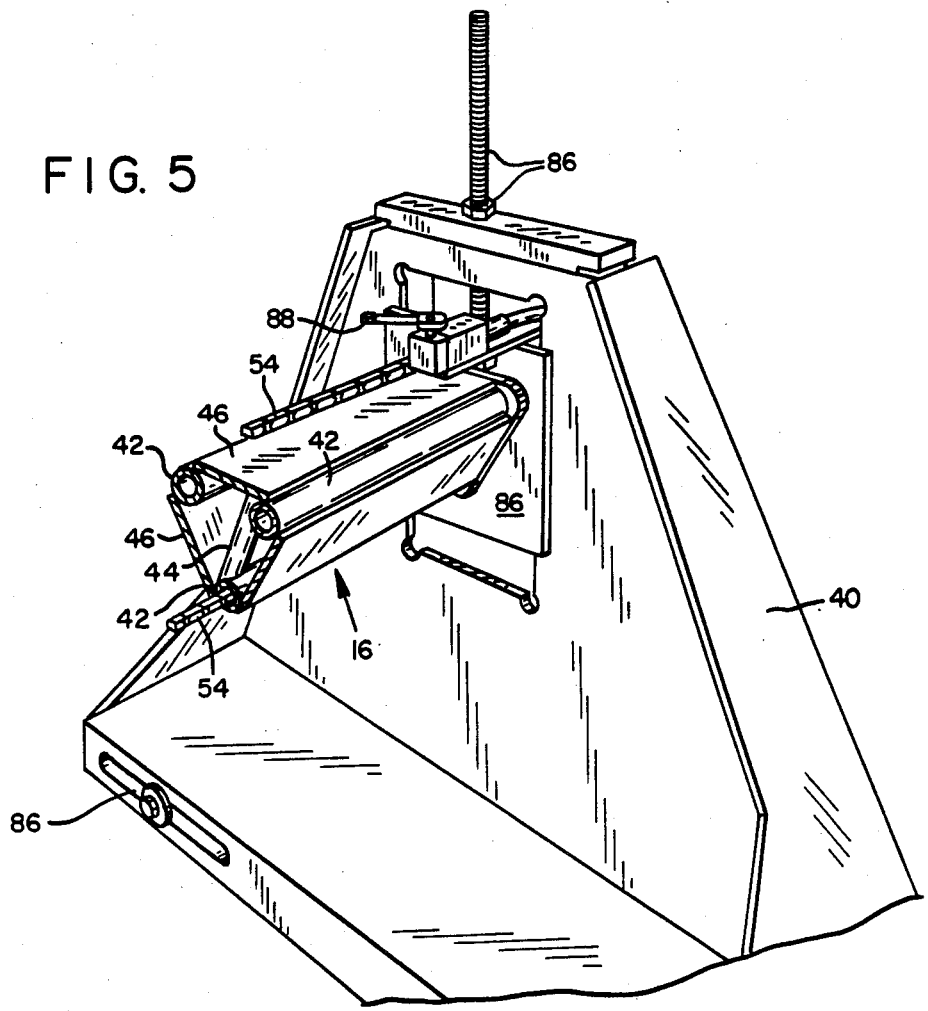
FIG. 5 is a perspective view of an end stand and a portion of the support beam.

FIGS. 1, 2 and 5, show that the support beam 16 on which the honing head is mounted is essentially an elongate triangular truss supported at each extremity by an end stand 40. The support beam includes three elongate members 42 interconnected by a plurality of web members 44. Flat elongate ways 46 are fastened between adjacent elongate members 42 to provide a smooth straight surface for the carriage rollers 36 of the honing head to move along. It may be desirable to stress the support beam with an internal cable arrangement (not shown) to prevent the support beam from sagging in the middle. As shown in FIGS. 1 and 5, the end stands have adjustment features 86 which permit the support beam to be moved both vertically and horizontally.

The large elongate cylinder 49 to be honed (for example, a typical cyclinder may be 36 inches in diameter and 33 feet long), is rotatably supported in a horizontal position by a pair of spaced-apart cylinder cradles 50, each cradle including a pair of trunnions 52 as shown in FIGS. 2 and 3. The elongate support beam extends completely through the cylinder and is supported by the end stands as shown in FIGS. 1, 2 and 5. The support beam extends through the triangular openings 20 in the end plates of the carriage and the honing head is movably supported on the support beam by the carriage rollers 36 so that the honing head may move axially through the elongate cylinder. As may be seen in FIGS. 1 and 2, a drive chain 54 is attached to each end of the honing head and trained over a drive sprocket 56 at one end stand and an idler sprocket 58 at the other end stand. A drive motor is connected to the drive sprocket and a pair of limit switches 88, one of which may be seen in FIG. 5, proximate each end of the cylinder and operatively connected with the drive motor, permit the honing head to be reiteratively moved back and forth within the cylinder.

As described above, each pneumatic motor 34 is connected to its respective shaft 30, on which a pair of stones 32 are also mounted. Of course, the case of the pneumatic motor is anchored to the trailing arm 28*a* to prevent the motor itself from rotating. An Ingersoll-Rand, flange mounted, multi-vane air motor, having a range of 200–1000 rpm is suitable for this application. An air hose 62 stored on a retractable spool 64 is connected to a source of compressed air and attached to the honing head assembly by a junction 66 which provides equal air pressure to each motor to rotate all honing stones at similar rpms. A regulator, not shown, permits the speed of all motors to be selectively increased or decreased by varying the amount of air supplied to the junction.

As may be understood with reference to FIG. 3, because the cylinder 49 is arranged horizontally, and because the honing head 10 itself does not rotate, the weight of each stone assembly, including its respective motor and stones, at the ends of the pivoting trailing arms tend to cause the stones of the various stone asemblies to press unevenly against the inner cylinder wall. Indeed, without some kind of biasing force to urge the stones out against the cylinder wall, the uppermost stone assembly shown in FIG. 3 would fall back against the carriage. Accordingly, it is necessary to provide not only a biasing force to each stone assembly to urge it toward the cylinder wall, but to be able to individually regulate the respective biasing forces to compensate for the effect of gravity upon each stone assembly.

Figure 6:
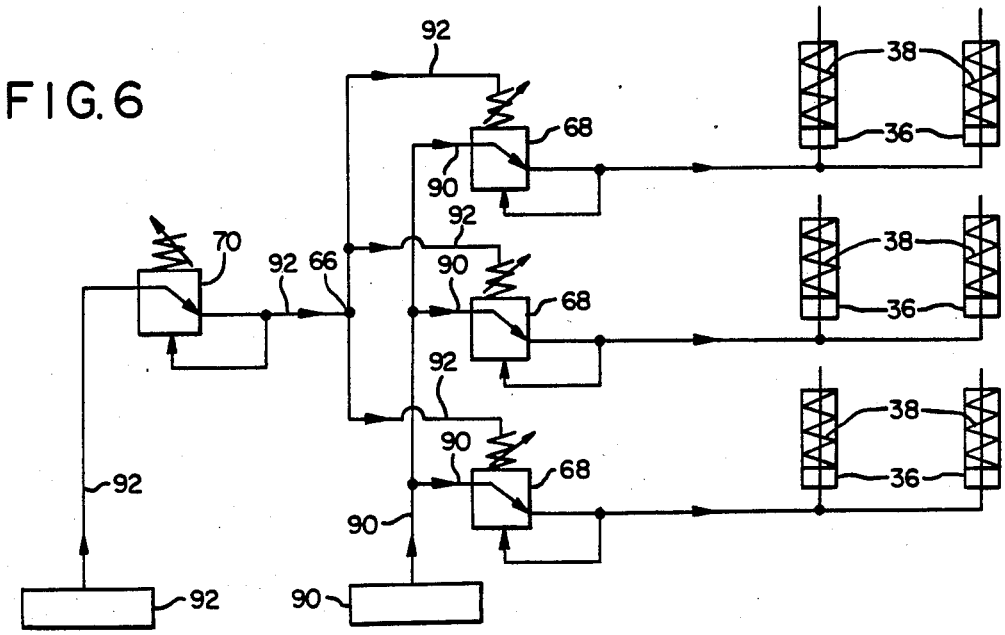
FIG. 6 is a schematic view of the system for biasing the honing stone assemblies.

In the exemplary embodiment of the present invention this biasing is accomplished by providing each stone assembly with a pair of air cylinders 36 interonnecting the outer ends of the respective trailing arms 28*a* and 28*b* to corresponding end plates of the carriage. As schematically shown in FIG. 6, each pair of air cylinders of each stone assembly is supplied with compressed air by a respective bias regulator 68, such as a Fairchild Multi-Stage Relay. The bias regulators provide each pair of air cylinders associated with a stone assembly with the appropriate amount of air pressure to substantially equalize the force with which each stone assembly is urged against the cylinder wall. Each bias regulator is connected to two sources of compressed air: air to actuate the air cylinders, hereinafter called cylinder air 90; and air to operate the bias regulator, hereinafter called bias air 92. Cylinder air 90 and bias air 92 are supplied to the honing head by a pair of air hoses mounted on a retractable spool in a manner shown and explained above with respect to the air supply for the pneumatic motors.

As diagramatically indicated, each bias regulator is individually, manually adjustable according to its relative position on the honing head. For example, the bias regulator associated with the air cylinders of the uppermost stone assembly is adjusted to provide relatively greater air pressure to those cylinders, while the bias regulator associated with air cylinders of the lowermost stone assembly is adjusted to provide relatively less air pressure to its associated cylinders. It should be understood that this arrangement allows the air pressure in all air cylinders to be increased or decreased by controlling the master regulator 70, the several bias regulators ensuring that the air pressure to each pair of air cylinders is increased or decreased proportionally. Since the air cylinders used in the exemplary embodiment are single acting cylinders, return springs 38 are necessary to retract the stone assemblies toward the carriage when the air pressure is decreased.

Referring again to FIGS. 2 and 3, in operation the cylinder 49 is rotated in its cradle 50 by a drive belt 72 driven by a variable speed motor (not shown). To prevent the cylinder from moving axially on its cradles, one end of the cylinder is fitted with an annular thrust ring 80 which is sandwiched between a pair of thrust rollers 82 mounted on a stanchion 84. As the cylinder is rotated the honing head is run back and forth through the cylinder on the support beam, the honing stones rotating at a desired speed determined by the amount of air provided to the pneumatic motors and the air cylinders providing each honing stone assembly with appropriate biasing force due to the bias regulators. Stone speed, stone biasing force, cylinder rpms and the rate at which the head is moved back and forth within the cylinder are all variable. For example, the biasing force may be increased, the speed of the stones increased (500 rpm), the rate at which the head moves axially through the cylinder decreased, and the cylinder rpms decreased to grind or remove material from the cylinder wall. Conversely, to polish the cylinder wall, the head is moved back and forth rapidly within the cylinder, the biasing force is decreased, the speed of the stones is decreased (100 rpm), and the cylinder rpms increased.

Some of the particular advantages of the invention may be understood with reference to FIG. 4. As previously explained, the cylinders often become out-of-round as represented by the large dashed irregularity 74 or develop a ridge bump or other small irregularity represented by the dashed bump 76. Prior art honing devices such as Baldwin et al., discussed above, which use the opposite cylinder wall to provide a reactive force to counter the biasing force would tend to reproduce such irregularities when the cylinder wall is honed. However, the honing device of the present invention is supported within the cylinder independent of the cylinder walls and the biasing force supplied to the stones react against the support beam, not the opposite cylinder wall. The use of air cylinders in combination with an independently supported honing head serves to keep the stones biased against the cylinder wall with a constant biasing force regardless of stone wear or cylinder wear during the honing process. This arrangement, coupled with the use of adjustable stops 48 permit the honing head to grind out any irregularities and achieve a substantially perfect cylindrical bore within the cylinder. For example, the adjustable stops may be set so that the honing stones are not permitted to contact the entire cylinder wall, only those portions which are irregular such as the areas designed as 74 and 76 in FIG. 4. Once the irregularities in the cylinder wall are ground out by the honing head the adjustable stops may be reset so that the entire cylinder wall may be polished.

It should also be noted that the adjustable stop feature allows the support beam and honing head to be positioned other than at the exact center of the cylinder. This is dramatically different from the prior art devices discussed above which are generally self-centering. Since the stops may be adjusted to conform to the actual distance between the carriage and the cylinder wall, it is not necessary to employ precise centering methods and equipment to ensure that the support beam is precisely coaxial with the cylinder.

The adjustable stops have another important function. Many cylinders have ports 78 or other openings in the cylinder wall as shown in FIG. 4. The adjustable stops prevent the stones from entering significantly into the port 78 and damaging the stone or disfiguring the port.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for grinding or honing the inner cylinder wall of an elongate cylinder comprising:

(a) an elongate, stationary, non-rotating support beam independent of said cylinder extending substantially through the axial length of said cylinder;

(b) a non-rotating honing head movably supported on said support beam for axial movement within said cylinder;

(c) said honing head including two or more rotatable honing means for honing said inner cylinder wall, each of said honing means having respective power means operatively associated therewith for rotating said honing means;

(d) each of said honing means having respective resilient biasing means operatively associated therewith for resiliently urging said honing means toward said inner cylinder wall; and (e) bias regulating means for equalizing the pressure of said respective honing means against said cylinder wall when said support beam is not centered axially within said cylinder.

2. An apparatus for grinding or honing the inner cylinder wall of an elongate cylinder comprising:

(a) an elongate, stationary, non-rotating support beam independent of said cylinder extending substantially through the axial length of said cylinder;

(b) a non-rotating honing head movably supported on said support beam for axial movement within said cylinder;

(c) said honing head including two or more rotatable honing means for honing said inner cylinder wall, each of said honing means having respective power means operatively associated therewith for rotating said honing means;

(d) each of said honing means having respective resilient biasing means operatively associated therewith for resiliently urging said honing means toward said inner cylinder wall; and (e) bias regulating means for equalizing the pressure of said respective honing means against said cylinder wall when said cylinder and support beam are oriented substantially horizontally with one of said honing means above the axis of said cylinder and another one of said honing means below the axis of said cylinder.

* * * * *

UNITED STATES PATENT AND TRADEMARK OFFICE

CERTIFICATE OF CORRECTION

PATENT NO. : 4,707,944

DATED : Nov. 24, 1987

INVENTOR(S) : Edward K. Parsons

It is certified that error appears in the above-identified patent and that said Letters Patent is hereby corrected as shown below:

| | |
|---|---|
| Col. 2, line 12 | Change "steps" to --stops-- |
| Col. 4, lines 23 and 24 | Change "interonnecting" to --interconnecting-- |
| Col. 5, line 4 | Change "designed" to --designated-- |

Signed and Sealed this

Fifteenth Day of November, 1988

*Attest:*

*Attesting Officer*

DONALD J. QUIGG

*Commissioner of Patents and Trademarks*